US007159552B2

(12) United States Patent
Backert et al.

(10) Patent No.: US 7,159,552 B2
(45) Date of Patent: Jan. 9, 2007

(54) CUP TAPPET FOR AN INTERNAL COMBUSTION ENGINE

(75) Inventors: Georg Backert, Mühlhausen (DE); Michael Dotterweich, Burgebrach (DE); Matthias Reichel, Obertrubach (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 11/285,608

(22) Filed: Nov. 22, 2005

(65) Prior Publication Data

US 2006/0107917 A1 May 25, 2006

(30) Foreign Application Priority Data

Nov. 23, 2004 (DE) ..... 10 2004 056 457

(51) Int. Cl.
*F01L 1/14* (2006.01)

(52) U.S. Cl. ..... 123/90.5; 123/90.48; 74/569

(58) Field of Classification Search ..... 123/90.48, 123/90.5, 90.39, 90.44; 74/567, 569
See application file for complete search history.

(56) References Cited

U.S. PATENT DOCUMENTS 5,823,151 A * 10/1998 Elendt et al. ..... 123/90.16

FOREIGN PATENT DOCUMENTS

| | | | |
|---|---|---|---|
| DE | 38 14700 | A1 | 11/1989 |
| DE | 695 11 627 | T2 | 8/1999 |
| DE | 196 80 280 | C1 | 11/2001 |
| DE | 101 10 914 | A1 | 9/2002 |
| DE | 101 23 963 | A1 | 11/2002 |
| WO | WO 2005/019608 | A1 | 3/2005 |

* cited by examiner

*Primary Examiner*—Ching Chang
(74) *Attorney, Agent, or Firm*—Charles A. Muserlian

(57) ABSTRACT

The invention relates to a cup tappet for an internal combustion engine, having a skirt which has a radial recess, into which an anti-rotation element (6) is inserted. The anti-rotation element protrudes from the skirt in the radial direction, in order to be accommodated in a corresponding groove of the cylinder head as an anti-rotation safeguard.

According to the invention, the anti-rotation element (6) has an outer contour in longitudinal section with a head (20) and a stem (21). The stem has a reduced dimension compared with the head (20) and a thickened portion (32), and can be clipped into the recess of the skirt of the cup tappet under elastic deformation of the thickened portion (32).

In this way, an anti-rotation safeguard is possible which can be assembled particularly simply, can be manufactured cheaply and is reliable.

9 Claims, 2 Drawing Sheets

CUP TAPPET FOR AN INTERNAL COMBUSTION ENGINE

FIELD OF THE INVENTION

The invention relates to a cup tappet for an internal combustion engine, according to the precharacterizing clause of claim 1.

BACKGROUND OF THE INVENTION

DE 196 00 852 A1 has disclosed a cup tappet for an internal combustion engine, which cup tappet is connected between a control cam and a valve. The cup tappet has a skirt which is configured to be approximately hollow-cylindrical and is guided in a hole of the cylinder head. The skirt has a radial recess, into which an anti-rotation element is inserted which prevents rotation of the cup tappet around the lifting axis relative to the cylinder head by the anti-rotation element engaging in the circumferential direction both into the cup tappet with a form-fitting connection and into a suitable groove of the cylinder head. For this purpose, the anti-rotation element protrudes out of the skirt in the radial direction. According to a first embodiment, the anti-rotation element is configured as a cylinder body, the longitudinal axis of which is oriented in the lifting direction and the end faces of which have grooves which open radially from the outside and into which a projection of the skirt engages. That circumferential surface of the anti-rotation element which lies outside the skirt engages into the groove of the cylinder head, while the inner circumferential surface bears against an inner body of the cup tappet. In accordance with a second embodiment, the anti-rotation element is configured as an elastic spring element in the form of a U-shaped clasp with two limbs and a back. The limbs of the clasp are inserted radially inwards into the recess of the cup tappet under elastic deformation, until embossed portions of the limbs latch into the limits of the recess of the skirt in the circumferential direction. According to a third embodiment, the anti-rotation element is configured as a slotted sleeve in the shape of a hollow cylinder, the longitudinal axis of which is oriented in the lifting direction. The sleeve has embossed portions which lie opposite one another and into which the limits of the recess of the skirt latch in the circumferential direction under elastic deformation of the sleeve.

DE 28 29 423 C2 has disclosed an anti-rotation element which does not serve to guard against rotation between the cup tappet and the cylinder head, but rather between individual components of the cup tappet. The special feature of the anti-rotation safeguard which is known from this publication is that, in addition to the function as an anti-rotation safeguard, it serves to supply oil through a central oil supply hole.

DE 41 15 670 A1 has disclosed an anti-rotation element which is configured as a shaped part and as a thin-walled sheet-metal or plastic part. The shaped part is supported centrally on a web of the cylinder head and, away from the said web, bears against two cup tappets in order to safeguard the latter against rotation. Here, the shaped part is fixed definitively by the camshaft being mounted or the shaped part being clamped between a guide housing and the cylinder head.

DE 43 24 756 C2 discloses a cup tappet which has an outer cup with an inner tappet which is guided in the outer cup such that it can be moved in translation by way of a hydraulic compensating element. An anti-rotation element engages such that it can move in translation into a guide groove on the receptacle hole in the cylinder head and into an aperture of the outer cup. In addition, the anti-rotation element engages into a guide groove of the inner tappet with a relatively large inner guide length or contact face. This increased inner guide length serves for reliable guiding between the inner tappet and the cup and prevents tilting of the outer guide length in the guide groove of the cylinder head. As a result, the production of chatter marks is avoided in the guide groove, which chatter marks could lead to jamming.

DE 195 01 061 A1 has disclosed a cup tappet, in which an inner part is in contact in a skirt. In this case, the anti-rotation element does not protrude beyond the inner casing of the skirt. The inner end face of the anti-rotation element is configured in accordance with a part segment of a circumferential surface of a cylinder, with the result that a large surface area of the inner part can bear against the abovementioned end face and an inner casing surface of the skirt.

DE 199 57 772 A1, for example, has disclosed an anti-rotation element which is of cylindrical configuration with its longitudinal axis in the direction of the lifting direction. The casing surface which is arranged so as to lie outside the cup tappet is guided in a guide groove with a circular segment-shaped contour in accordance with the outer contour of the cylinder.

Further anti-rotation elements are known, for example, from DE 101 23 966 A1 and DE 43 37 330 A1.

OBJECT OF THE INVENTION

The invention is based on the object of proposing a cup tappet which is safeguarded against rotation and ensures simple assembly and satisfactory functioning and operational reliability, with it being possible to manufacture the cup simply, in particular the recess of the skirt, and/or the anti-rotation element.

SUMMARY OF THE INVENTION

According to this invention, the anti-rotation element has a particular outer contour of such a type that it has a head and a stem in the longitudinal section of the anti-rotation element. The anti-rotation element can have this outer contour, for example, in the installed state in a section through the longitudinal axis of the anti-rotation element and the axis of the lifting direction and/or through the longitudinal axis and an axis which is oriented in the circumferential direction of the cup tappet. There is, in particular, a mushroom-shaped outer contour because of the head and the stem.

Furthermore, according to the invention, the anti-rotation element has a thickened portion in the region of the stem. The anti-rotation element can be clipped into the recess of the skirt under elastic deformation of the thickened portion. It is clear that corresponding longitudinal sides of the recess also experience elastic deformation.

The force required for assembly which is necessary for the clipping-in operation can be predefined by stipulation of the thickened portion via

- its design and outer contour,
- the material selection and pairing for thickened portion, stem and the limit of the recess,
- the height of the thickened portion,
- any insertion bevels of the thickened portion.

Secondly, the abovementioned parameters can be used to predefine how satisfactory the securing of the anti-rotation element in the recess of the skirt is, as renewed application of the elastic deformation is required for the anti-rotation element to fall out or to tilt or to change position. It is entirely possible here for the necessary forces firstly for clipping in the anti-rotation element and secondly for removing it to be different, for example via the design of the contour or the material pairing of the thickened portion, and in particular via any insertion or removal bevels in the edge regions of the thickened portion.

According to the invention, the dimension transversely with respect to the longitudinal axis in the abovementioned section of the head is greater than the dimension of at least a part region of the stem. This ensures that the head is supported with respect to the outer circumferential surface of the skirt at a relatively large spacing from the longitudinal axis. Firstly, the lever arm of the support can be increased as a result. Secondly, the length of a supporting line or the size of a supporting face is increased according to the invention. The consequence is improved securing of the anti-rotation element with regard to tilting with respect to the skirt, which results in improved positional security. In addition to the improved securing which is caused by this against the anti-rotation element falling out unintentionally, this also has advantages with regard to the guiding of the anti-rotation element in the guide groove, as even slight tilting is in some circumstances at least reduced, as a result of which increased guiding accuracy can be brought about. These advantages cannot be achieved, in particular, with a clasp in accordance with the second embodiment according to DE 196 00 852 A1.

A further advantage of the design according to the invention is that, as a consequence of the elastic deformation of the anti-rotation element, the tolerances can be selected to be greater both for the anti-rotation element and for the wall thickness of the cup tappet and for the contour of the recess, as any deviations from an ideal dimension can be compensated for by elastic deformation. An oblique design of at least one contact face results in a yet further improvement in the tolerance of such deviations, as the oblique faces do not define an exact position, but rather a slight displacement of a contact face is possible (with a changed pressing-in force being accepted). As a result, grouping of cup and anti-rotation element can be rendered superfluous in some circumstances.

In accordance with one development of the cup tappet according to the invention, the stem has two part regions, namely a first part region which forms the thickened portion and a second part region which is arranged between the first part region and the head. The outer dimension of the second part region is smaller than that of the thickened portion. The anti-rotation element is clipped into the recess in the radial direction towards the interior of the cup tappet, the outer dimension of the first part region, that is to say of the thickened portion, being reduced elastically here. This elastic reduction is oriented, in particular, in the circumferential direction. In the installed state, the anti-rotation element is secured with respect to the skirt radially inwardly with a contact face which is formed by the head and with which the head bears against the circumferential surface of the skirt. In addition, a contact face is provided which secures the anti-rotation element radially outwardly. The said contact face is formed by the transition region from the first part region to the second part region.

According to a first refinement, this transition region can be configured as a sudden jump, with the result that a contact face is produced which is configured transversely with respect to the longitudinal axis of the anti-rotation element. As a result, particularly satisfactory securing of the axial position of the anti-rotation element in the recess can be brought about, as form-fitting securing via the two contact faces is carried out by applying a force to the anti-rotation element in the radial direction.

According to a second refinement, the transition region is configured as an inclined slope. This has the consequence that, if a force is applied to the anti-rotation element radially outwardly, the force is divided into a force which is oriented in the longitudinal direction of the anti-rotation element and a transverse force which is oriented transversely with respect to the longitudinal axis of the anti-rotation element. This transverse force acts towards an elastic reduction of the outer dimension of the first part region or the thickened portion, with the result that, in some circumstances, the clipped-in connection can be released again for dismantling with the sufficient application of a force radially outwardly, and the cup tappet can be removed from the recess. The force which is required for dismantling can be dimensioned by a suitable design of the inclined slope or a corresponding curve-shaped profile, in such a way that an optimum solution results for operational reliability and for making dismantling possible.

The cup tappet according to the invention is preferably equipped with an anti-rotation element which is manufactured from a solid material. Particularly satisfactory possibilities for production which in some circumstances can be made relatively inexpensive result for a solid material of this type. It is likewise possible for particularly defined rigidity properties to result for a solid material, in particular in the region of the thickened portion, and/or for a particularly satisfactory operating strength to result for the anti-rotation element.

In accordance with one development of the cup tappet according to the invention, the anti-rotation element is manufactured from plastic, for example from a thermoplastic or a thermoset, or any desired metal with the desired mechanical properties. The abovementioned materials can be used, for example, via casting, forming, injection molding or material-removing processing. Forming manufacturing from a metal sheet is possible, for example.

According to one particular refinement, the anti-rotation element is manufactured from an extruded section. Here, it is conceivable for the contour according to the invention in the abovementioned longitudinal section to correspond to the outer contour of the extruded section, from which the individual anti-rotation elements are then severed or punched out. A metal 100 CR 6, for example, is used as material.

In the cup tappet according to the invention, the spacing of the abovementioned contact faces is preferably in correlation with the wall thickness of the skirt in the region of the recess. Here, the wall thickness and the spacing of the contact faces can form a transitional locating fit, an interference fit or a clearance fit.

For one particular refinement of the cup tappet, the anti-rotation element is of multi-functional configuration. In a multi-functional refinement of this type, the anti-rotation element can serve, in addition to being an anti-rotation safeguard, as an oil supply means from the outside into the interior of the cup tappet. As an alternative or in addition, it is possible for an end region which faces away from the head of the anti-rotation element, for example with an end face or a side face, to serve as an (anti-rotation) safeguard for an inner body of the cup tappet.

According to one particular development of the invention, the recess of the skirt is of approximately rectangular configuration in cross section and has longitudinal and transverse sides which are connected to one another via rounded-off corner regions. The longitudinal and transverse sides have in each case projections, for example approximately centrally. In the region of the transverse sides, the projections form contact regions which accommodate the anti-rotation element in the lifting direction with a transitional locating fit. Projections in the region of the longitudinal sides form contact regions which become operatively connected to the thickened portion of the anti-rotation element and between which the second part region is accommodated in the assembled position. It is particularly satisfactorily possible to manufacture a recess of this type with a sufficient manufacturing accuracy, as a relatively great tolerance can be selected for those regions of the recess which lie away from the projections (rounded-off corner regions), as they do not become operatively connected functionally with the anti-rotation element. For the projections which are assigned to the longitudinal sides and the transverse sides, identical or different manufacturing accuracies can be selected in accordance with the abovementioned requirements. Here, it is possible, for example, for the projections to be manufactured initially with defined excess dimensions and to be brought to desired dimensions in a targeted manner in a subsequent work operation.

For the case where the anti-rotation element has an insertion bevel, the said anti-rotation element can be inserted into the recess particularly easily radially inwardly during assembly, the insertion bevel forming guide surfaces in the case of imprecise insertion.

A contact face which is improved further between the anti-rotation element and the skirt of the cup tappet results if the contact face which is assigned to the head is curved in accordance with the circumferential surface of the skirt. As a result, punctiform or linear contact regions can be avoided, as a large surface area of the head bears against the circumferential surface of the skirt. This results in improved supporting conditions.

BRIEF DESCRIPTION OF THE DRAWINGS

Further features of the invention result from the following description and the associated drawings, in which one exemplary embodiment of a cup tappet according to the invention is shown diagrammatically and in which.

DETAILED DESCRIPTION OF THE DRAWINGS

Figure 1:
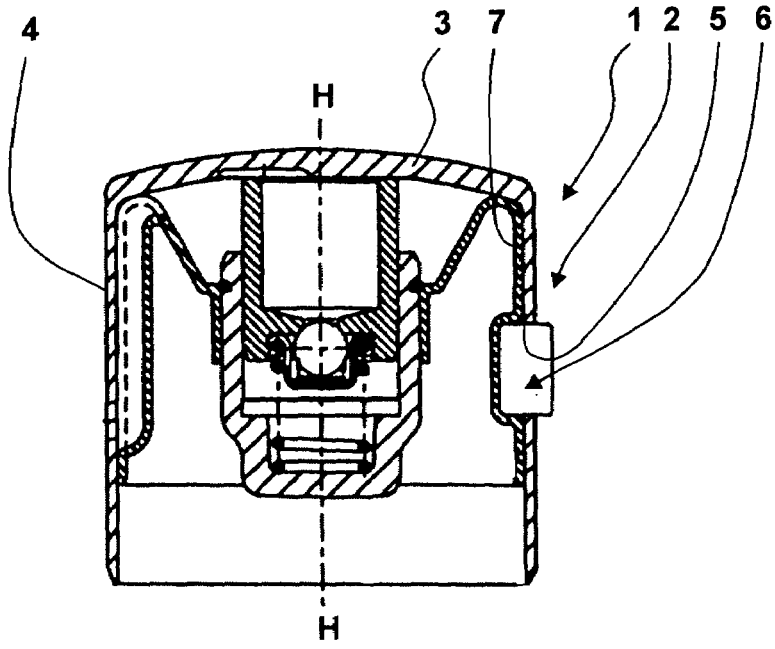
FIG. 1 shows a cup tappet in section in the direction of the lifting axis H—H.

FIG. 1 shows a cup tappet 1 having a cup 2 which has a base 3 which interacts with a control cam, and having a skirt 4. The skirt 4 is of approximately hollow-cylindrical configuration and is guided so as to be displaceable in the direction of the lifting axis H—H in a suitable hole of the internal combustion engine, in particular of the cylinder head, the circumferential surface of the skirt 4 serving as a guide surface. The skirt 4 has a radial recess 5, radial denoting a direction which is transverse with respect to the lifting axis H—H in the present application. An anti-rotation element 6 is inserted into the recess 5 in the radial direction, which anti-rotation element 6 is supported with respect to the limit of the recess 5 in the circumferential direction about the lifting axis H—H and in the lifting direction H—H. According to FIG. 1, that part of the anti-rotation element 6 which is arranged on the radial inside of the skirt 4 engages with a form-fitting connection into an inner body 7 of the cup tappet 1, as a result of which the latter is fixed or limited in its displacement both in the direction of the lifting axis H—H and in the circumferential direction. Lying radially on the outside, the anti-rotation element 6 is accommodated with a form-fitting connection in a guide groove of the hole for the cup tappet 1 in the circumferential direction about the lifting axis H—H, the said guide groove extending in the direction of the lifting axis H—H, with the result that a displacement of the cup tappet 1 in the direction of the lifting axis H—H is not impeded by the anti-rotation element 6, while a rotation of the cup tappet 1 about the lifting axis H—H is precluded or restricted. The anti-rotation element 6 is shown only diagrammatically in FIG. 1, and is shown in detail in a manner which deviates from FIG. 1 for the present invention.

Figure 2:
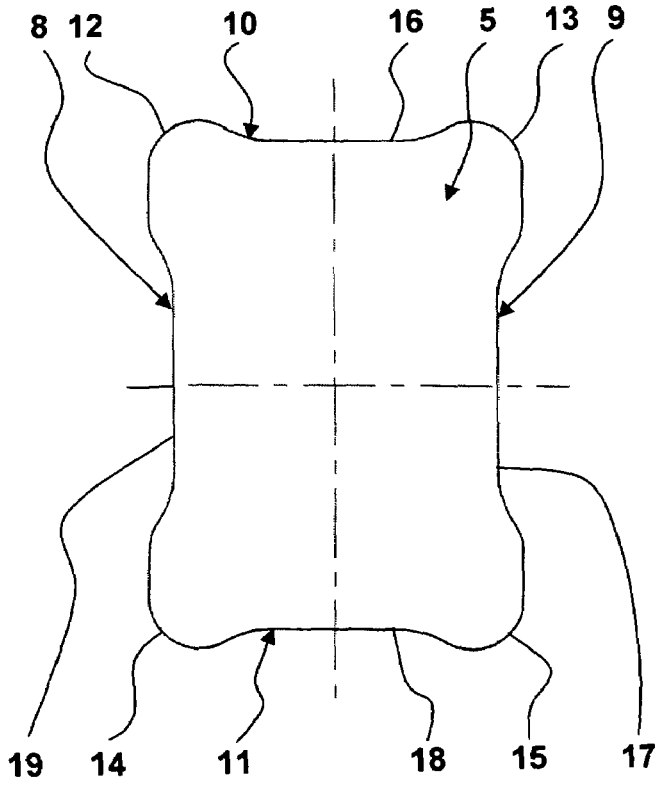
FIG. 2 shows a contour of a radial recess of a skirt of a cup tappet, in a viewing direction which is radial with respect to the lifting axis H—H.

FIG. 2 shows a contour of the limit of the recess 5. According to this, the recess has longitudinal sides 8, 9 and transverse sides 10, 11 which form approximately a rectangle. The recess 5 has rounded-off corner regions 12, 13, 14, 15 and, approximately centrally, projections 16, 17, 18, 19 which are oriented parallel to opposite projections 16–19 and at right angles to adjacent projections 16–19 and extend approximately over half the length of the longitudinal and transverse sides 8–11.

Figure 3:
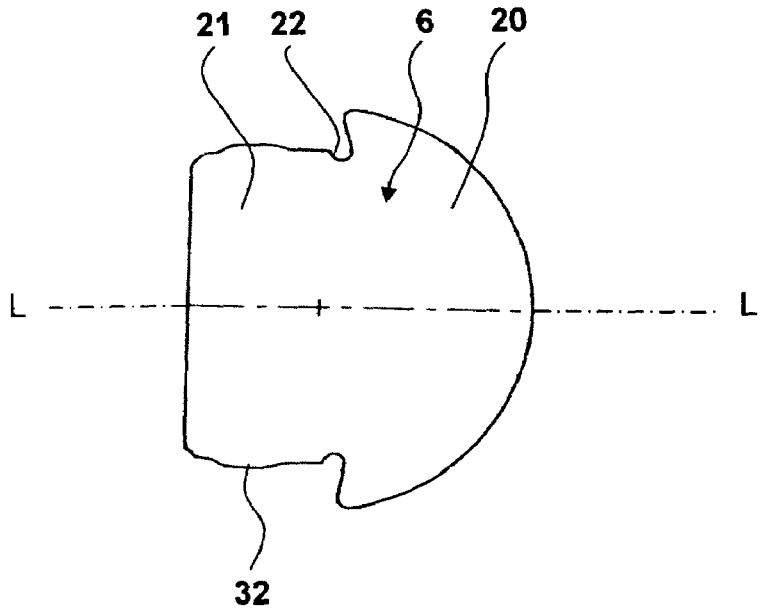
FIG. 3 shows an anti-rotation element in longitudinal section.

FIG. 3 shows an anti-rotation element 6 according to the invention. The anti-rotation element 6 has a head 20 and a stem 21 which are connected to one another via a cut-out 22, in particular with a constant radius. In the longitudinal section which is shown in FIG. 3, the anti-rotation element 6 is configured symmetrically with respect to the longitudinal axis L—L. The head 20 has a contour which is configured to be curved, in particular in the shape of a partial circle or a semicircle, and has, in particular, a surface which corresponds to part of a circumferential surface of a cylinder.

Figure 4:
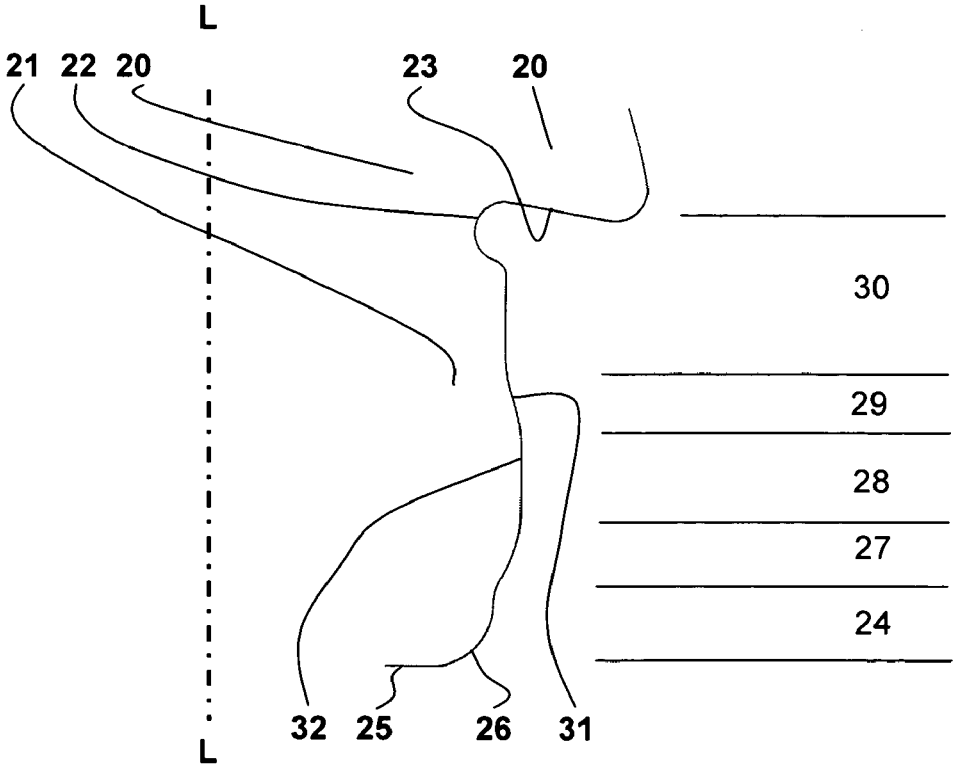
FIG. 4 shows an enlarged detail of an outer contour of the anti-rotation element according to FIG. 3.

The contour of the anti-rotation element 6 can be seen in an enlarged partial longitudinal section according to FIG. 4. The head forms a contact face 23 with an end face, the inclination of which contact face 23 corresponds approximately to the inclination of the associated region of the circumferential surface of the skirt 4. In the longitudinal section which is shown in FIG. 4, the contact face 23 is preferably of circular segment-shaped configuration, the radius of the contact face 23 corresponding to the spacing of the circumferential surface of the skirt 4 or of the head 20 from the lifting axis H—H in the installed state, and the center point of the circular segment-shaped contour of the contact face 23 lying on the lifting axis H—H in the installed state.

The stem 21 has a part region 24 which is assigned to that end side 25 of the stem 21 which faces away from the head 20. The part region 24 has a bevel 26 which serves to make insertion of the anti-rotation element 6 into the recess 5 easier. In the direction of the head, a transition region 27 adjoins the part region 24. In the transition region 27, the spacing of the contour shown from the longitudinal axis L—L is increased continuously, for example with an oblique or curved profile. A first part region 28 adjoins the transition region 27 with a straight outer contour at a constant spacing from the longitudinal axis L—L. A transition region 29 adjoins the first part region 28, in which transition region 29 the spacing from the longitudinal axis L—L decreases in a straight or curved line until a second part region 30 with a straight contour and a constant spacing from the axis L—L. The second part region 30 has the cut-out 22 in the end region for the transition to the head 20.

Vertically with respect to the plane of the drawing according to FIG. 4, the anti-rotation element 6 has approximately a constant contour with a substantially constant spacing to the longitudinal axis L—L. Perpendicularly with respect to the plane of the drawing, the extent is such that the anti-rotation element 6 is accommodated with suitable end faces between those end faces of the skirt 4 which are formed by the projections 16, 18, with a clearance fit, a transitional locating fit or an interference fit.

When the anti-rotation element 6 is inserted into the recess 5, the part region 24 with the bevel 26 initially becomes operatively connected to the projections 17, 19, as a result of which a centering action is achieved and further, radially inward insertion of the part region 24 is made possible. If the anti-rotation element 6 is inserted further radially, the pressing force between the limit of the recess 5 and the transition region 27 is increased in the region of the transition region 26 in accordance with the spacing of the contact region from the longitudinal axis L—L, which is associated with a radially inward elastic deformation of the skirt 4 or of the anti-rotation element 6. In the first part region 28, the anti-rotation element 6 can be moved further radially inwards if the frictional force is overcome between the first part region 28 and the limit of the recess 5. In the transition region 29, the pressing force is reduced between the anti-rotation element 26 and the limit of the recess 5, the transition region 29 in some circumstances assisting the radially inward movement as a consequence of the inclined slope. A movement continues until the head 20 with the contact face 23 comes into contact with the outer circumferential surface of the skirt 4.

In the assembled position, the skirt 4 is thus accommodated without play between the contact face 23 and a contact line or face 31 formed in the transition region 29, or with the generation of play or under prestress. Here, the spacing of the contact faces 23, 31 corresponds to the wall thickness of the skirt 4. The part region 24, transition region 27 and first part region 28 can fulfill further functions in the assembled state.

As a consequence of the form-fitting accommodation according to the invention between the two contact faces 23, 31, no substantial positional change of the anti-rotation element 6 relative to the cup 2 results in the operating state. The anti-rotation element 6 and the recess 5 can be manufactured inexpensively. The result is thus at least reduced rejects and a reduction of any necessary reworking as a consequence of stresses caused by interference fits. Furthermore, the manufacturing tolerances for the recess 5 and the anti-rotation element 6 can be made greater, as a result of which the manufacturing costs can likewise be reduced. Grouping of the anti-rotation element 6 and the associated cup 2 is possible according to the invention, but no longer necessary in some circumstances.

For one particular refinement, the spacing of the projections 17, 19 is 3.07 mm in the circumferential direction, while the part region 24 has an extent of 3 mm in the circumferential direction, the first part region 28 has an extent of 3.17 mm and the second part region 30 has an extent of 3.07 mm. An extruded section, in particular, is used as the material, in which the longitudinal faces form the contour according to FIG. 4 and which is severed into individual parts in the direction of the lifting axis H—H. The material is, in particular, 100 CR 6. A thickened portion 32 is formed in the region of the first part region 28.

LIST OF REFERENCE NUMERALS

1 Cup tappet
2 Cup
3 Base
4 Skirt
5 Recess
6 Anti-rotation element
7 Inner body
8 Longitudinal side
9 Longitudinal side
10 Transverse side
11 Transverse side
12 Rounded-off corner region
13 Rounded-off corner region
14 Rounded-off corner region
15 Rounded-off corner region
16 Projection
17 Projection
18 Projection
19 Projection
20 Head
21 Stem
22 Cut-out
23 Contact face
24 Part region
25 End side
26 Bevel
27 Transition region
28 First part region
29 Transition region
30 Second part region
31 Contact face
32 Thickened portion

The invention claimed is:

1. A cup tappet for an internal combustion engine, having a skirt (4) which has a radial recess (5), into which an anti-rotation element (6) is inserted which protrudes from the skirt (4) in the radial direction, characterized in that the anti-rotation element (6)

a) has an outer contour in longitudinal section with a head (20) and a stem (21), where the stem (21) has a reduced dimension compared with the head (20), at least in longitudinal section, and has a thickened portion (32), and b) can be clipped into the recess (5) under elastic deformation of the thickened portion (32), wherein a) the stem (21) has a first part region (28) which forms the thickened portion (32) and a second part region (30) which is arranged between the first part region (28) and the head (20), and the outer dimension of the second part region (30) is smaller than that of the thickened portion (32), b) the anti-rotation element (6) can be clipped into the recess (5) in the radial direction under elastic reduction of the outer dimension of the first part region (28), and c) in the installed state, the anti-rotation element (6) is secured with respect to the skirt (4) radially inwardly with a first contact face (23) which is formed by the head (20), and radially outwardly by a second contact face.(31) which is formed in a transition region (29) from the first part region (28) to the second part region (30).

2. The cup tappet of claim 1, wherein the anti-rotation element (6) is manufactured from a solid material.

3. The cup tappet of claim 1, wherein the anti-rotation element (6) is manufactured from plastic or a metal.

4. The cup tappet of claim 1, wherein the anti-rotation element (6) is manufactured from an extruded section.

5. The cup tappet of claim 1, wherein the spacing of the contact faces (23, 31) is in correlation with the wall thickness of the skirt (4).

6. The cup tappet of claim 1, wherein the anti-rotation element (6) is of multi-functional configuration.

7. The cup tappet of claim 1, wherein the anti-rotation element (6) has a bevel (26).

8. The cup tappet of claim 1, wherein the first contact face (23) which is assigned to the head (20) is curved in accordance with the circumferential surface of the skirt (4).

9. A cup tappet for an internal combustion engine, having a skirt (4) which has a radial recess (5), into which an anti-rotation element (6) is inserted which protrudes from the skirt (4) in the radial direction, characterized in that the anti-rotation element (6) a) has an outer contour in longitudinal section with a head (20) and a stem (21), where the stem (21) has a reduced dimension compared with the head (20), at least in longitudinal section, and has a thickened portion (32), and can be clipped into the recess (5) under elastic deformation of the thickened portion (32), wherein the recess (5) is of approximately rectangular cross section with longitudinal sides (8, 9), transverse sides (10, 11), and rounded-off corner regions (12, 13, 14, 15), as well as projections (16, 18) for forming contact regions in the region of the transverse sides (10, 11), where contact regions accommodate the anti-rotation element (6) in the lifting direction (H—H) with a transitional locating fit, and projections (17, 19) for forming contact regions in the region of the longitudinal sides (8, 9), where contact regions become operatively connected to the thickened portion (32) of the anti-rotation element (6) and between which a second part region (30) is accommodated in an assembled position.

* * * * *